US007742022B2

(12) United States Patent
Kim et al.

(10) Patent No.: US 7,742,022 B2
(45) Date of Patent: Jun. 22, 2010

(54) ORGANIC ELECTRO-LUMINESCENCE DISPLAY DEVICE AND DRIVING METHOD THEREOF

(75) Inventors: Hak Su Kim, Seoul (KR); Jae Do Lee, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 888 days.

(21) Appl. No.: 11/405,628

(22) Filed: Apr. 18, 2006

(65) Prior Publication Data

US 2007/0018916 A1 Jan. 25, 2007

(30) Foreign Application Priority Data

Jul. 22, 2005 (KR) ..... 10-2005-0066941

(51) Int. Cl.
*G09G 3/30* (2006.01)

(52) U.S. Cl. ..... 345/76; 345/82; 315/169.1

(58) Field of Classification Search ..... 345/76–83; 315/169.1–169.4
See application file for complete search history.

(56) References Cited

U.S. PATENT DOCUMENTS

| | | | | |
|---|---|---|---|---|
| 6,369,786 | B1 * | 4/2002 | Suzuki | 345/77 |
| 7,106,281 | B2 * | 9/2006 | Kim et al. | 345/76 |
| 7,400,098 | B2 * | 7/2008 | Ng et al. | 315/169.3 |
| 2002/0196215 | A1 | 12/2002 | Tsuchida et al. | |
| 2004/0196275 | A1 | 10/2004 | Hattori | |
| 2005/0140599 | A1 * | 6/2005 | Lee et al. | 345/76 |
| 2005/0212445 | A1 * | 9/2005 | Lee | 315/169.3 |
| 2005/0264499 | A1 | 12/2005 | Kim et al. | |
| 2006/0050032 | A1 * | 3/2006 | Gunner et al. | 345/82 |
| 2006/0279492 | A1 * | 12/2006 | Chen | 345/77 |

FOREIGN PATENT DOCUMENTS

| | | | |
|---|---|---|---|
| JP | 11-231834 | A | 8/1999 |
| JP | 11-311970 | A | 11/1999 |
| JP | 2001-296837 | A | 10/2001 |
| JP | 2003-114645 | A | 4/2003 |
| JP | 2004-045488 | A | 2/2004 |
| JP | 2005-70227 | A | 3/2005 |
| JP | 2005-189497 | A | 7/2005 |
| JP | 2005-346076 | A | 12/2005 |
| JP | 2006-153905 | A | 6/2006 |
| WO | WO-2004/047065 | | 6/2004 |

* cited by examiner

*Primary Examiner*—Kimnhung Nguyen
(74) *Attorney, Agent, or Firm*—BIrch, Stewart, Kolasch & Birch, LLP

(57) ABSTRACT

There is disclosed an organic EL display device using pre-charge which can improve display quality by preventing a cross talk generated by a brightness difference within the same picture realization area, and a driving method thereof.

An organic EL display device according to an embodiment of the present invention includes a display panel where a plurality of data lines cross a plurality of scan lines and electro luminescence cells are arranged in the crossing parts thereof; a pre-charge driver for supplying a pre-charge current to the data line in accordance with gray levels of data; and a data driver for charging a data current to the data line for a designated period which is set before a scan pulse is supplied to the electro luminescence cell and after the pre-charge current is supplied.

10 Claims, 11 Drawing Sheets

ORGANIC ELECTRO-LUMINESCENCE DISPLAY DEVICE AND DRIVING METHOD THEREOF

This application claims the benefit of the Korean Patent Application No. P2005-0066941 filed on Jul. 22, 2005 which is hereby incorporated by reference.

BACKGROUND OF THE INVENTION

1. Field of the Invention

The present invention relates to an organic electro luminescence display device, and more particularly to an organic electro luminescence display device using pre-charge, and a driving method thereof.

2. Description of the Related Art

Recently, there have been developed various flat panel display devices of which the weight and size can be reduced, wherein the weight and size is a disadvantage of a cathode ray tube CRT. The flat panel display device includes liquid crystal display (hereinafter, referred to as "LCD"), field emission display (hereinafter, referred to as "FED"), plasma display panel (hereinafter, referred to as "PDP"), and electro-luminescence display (hereinafter, referred to as "EL").

The PDP has a relatively simple structure and fabricating process, thus the PDP is advantageous in being made into a large screen, but there is a disadvantage in that its light emission efficiency and brightness is low and its power consumption is high.

The LCD has its demand increased as it is mainly used as a display device of a notebook computer. However, the LCD is fabricated by a semiconductor process, thus it is difficult to be made into the large screen. And, because the LCD is not a self-luminous device, there is a disadvantage in that a separate light source is required and power consumption is big due to the light source. Further, the LCD has a disadvantage in that a lot of light loss is caused by optical devices such as a polarizing filter, a prism sheet, a diffusion plate, etc and its viewing angle is narrow.

The EL display device is roughly divided into an inorganic EL display device and an organic EL display device, and has an advantage in that its response speed is fast and its light emission efficiency, brightness and viewing angle are high. The organic EL display device can display a picture in a high brightness of tens of thousands [cd/m$^2$] with a voltage of about 10[V] or so, and is applied to most of the EL display devices which are put to practical use.

A unit device of the organic EL display device, as shown in FIG. 1, forms an anode 2 of transparent conductive material on a glass substrate 1, and a hole injection layer 3, a light emitting layer of organic material and a cathode 5 of metal of which a work function is low, on top thereof. If an electric field is applied between the anode 2 and the cathode 5, holes within the hole injection layer 3 and electrons within the metal respectively move toward the light emitting layer 4 to be combined with each other in the light emitting layer 4. Then, a fluorescent material within the light emitting layer 4 is excited to have a transition made, thereby generating a visible ray. At this moment, the brightness is proportional to a current between the anode 2 and the cathode 5.

The organic EL display device is divided into a passive type and an active type.

FIG. 2 is a circuit diagram equivalently representing a part of an organic EL display device of a passive type, and FIG. 3 is a waveform diagram representing waveforms of a scan signal and a data signal of the passive type organic EL display device.

Referring to FIGS. 2 and 3, the passive type organic EL display device includes a plurality of data lines D1 to Dm and a plurality of scan lines S1 to Sn which cross each other; and organic EL cells OLED respectively formed at the crossing parts between the data lines D1 to Dm and the scan lines S1 to Sn.

The data lines D1 to Dm are connected to the anode of the organic EL device OLED to supply a data current Id to the anode of the organic EL device OLED.

The scan lines S1 to Sn is connected to the cathode of the organic EL cell OLED to supply scan pulses SP1 to SPn synchronized with the data current Id to the cathode of the organic EL cell OLED.

The organic EL cell OLED emits light in proportion to the current flowing between the anode and the cathode during a display period DT when the scan pulses SP1 to SPn are applied.

The organic EL cell OLED of the organic EL display device has a problem that its response speed is low and its brightness is low because a current is charged therein during a response time RT delayed by a capacitance existing in the organic EL cell OLED and a resistance component of the data lines D1 to Dm. In order to compensate the low response speed of the organic EL cell OLED, there is recently proposed a technique that a pre-charge period is provided as a non-display period between display periods DT.

On the other hand, in the organic EL display device, in case of realizing a designated picture, a pre-charge voltage waveform in contradiction to the same pre-charge period is made differently in accordance with locations of the data lines D1 to Dm and the scan lines S1 to Sn, thereby generating a problem such as a horizontal cross talk.

In reference to FIGS. 4 and 5, a description will be made in detail as follows.

Firstly, FIG. 4 represents a still picture has a black picture realized in the middle of the picture and a white picture realized in an area except the black picture.

In this case, even though the data current and the pre-charge current for representing the same brightness are applied between a white picture area (hereinafter, referred to as "first white area A") horizontally adjacent to and a white picture area (hereinafter, referred to as "second white area B") vertically adjacent to the area where the black picture is realized, there is generated a drive voltage (current) deviation due to a difference of loading quantity in a horizontal line direction.

In other words, the organic EL cells OLED corresponding to the black picture area in an $(N+1)^{th}$ scan line do not emit light, thus the loading quantity corresponding to non-light-emitting organic EL cells OLED is excluded from the total loading quantity in the $(N+1)^{th}$ scan line. Accordingly, a higher drive voltage is charged in the second white area B than in the first white area A, wherein the second white area B corresponds to the $N^{th}$ scan line of which the loading quantity is relatively larger than the $(N+1)^{th}$ scan line.

After this, even though the pre-charge current of the same size is applied to the first white area A and the second white area B, the drive voltage deviation between the first white area A and the second white area B is maintained intact.

As a result, as shown in FIG. 5, the amount of the current charged in the data line corresponding to the $(N+1)^{th}$ scan line in contradiction to the same pre-charge period is relatively lower than the amount of the current charged in the data line corresponding to the $N^{th}$ scan line, thus there is generated a cross talk problem by the brightness difference (or drive voltage deviation) between the first white area A and the second white area B although the same data current and pre-charge current is supplied for expressing the same gray level.

SUMMARY OF THE INVENTION

Accordingly, it is an object of the present invention to provide an organic EL display device using pre-charge which can improve display quality by preventing a cross talk generated by a brightness difference within the same picture realization area, and a driving method thereof.

In order to achieve these and other objects of the invention, an organic electro luminescence display device according to an aspect of the present invention includes a display panel where a plurality of data lines cross a plurality of scan lines and electro luminescence cells are arranged in the crossing parts thereof; a pre-charge driver for supplying a pre-charge current to the data line in accordance with gray levels of data; and a data driver for charging a data current to the data line for a designated period which is set before a scan pulse is supplied to the electro luminescence cell and after the pre-charge current is supplied.

In the organic electro luminescence display device, the data driver supplies the data current for electro luminescence to the electro luminescence cell at the same time as a scan pulse is supplied to the electro luminescence cell.

The organic electro luminescence display device further includes a scan driver for supplying the scan pulse synchronized with the data current supplied to the electro luminescence cell to the scan lines.

In the organic electro luminescence display device, the designated period before the scan pulse is supplied to the electro luminescence cells and after the pre-charge current is supplied is obtained from a light emitting period of the electro luminescence cell.

In the organic electro luminescence display device, the designated period before the scan pulse is supplied to the electro luminescence cells and after the pre-charge current is supplied is obtained by maintaining the light emitting period of the electro luminescence cells and by lengthening a period from a starting point of the scan pulse to a starting point of the next scan pulse.

The organic electro luminescence display device further includes a lookup table having pre-charge current data registered, wherein the pre-charge current data indicates the current amount of the pre-charge current corresponding to a gray level of the data; and a controller for controlling the pre-charge driver in accordance with the supply of the data current and the pre-charge current.

In the organic electro luminescence display device, the pre-charge driver includes a plurality of current sources of which the current values are different from each other; a selector for selecting any one of the current sources as the pre-charge current; and first and second switch devices for selectively supplying the pre-charge current and the data current to the data line.

In the organic electro luminescence display device, an early increase and decrease rate and a latter increase and decrease rate of a current charged in the data line for the designated period before the scan pulse is supplied to the electro luminescence cells and after the pre-charge current is supplied are different from each other.

In the organic electro luminescence display device, an early increase and decrease rate of a current charged in the data line for the designated period before the scan pulse is supplied to the electro luminescence cells and after the pre-charge current is supplied is higher than the latter increase and decrease rate.

A driving method of an organic electro luminescence display device where a plurality of data lines cross a plurality of scan lines and electro luminescence cells are arranged in the crossing parts thereof according to another aspect of the present invention includes supplying a pre-charge current to the data line in accordance with gray levels of data; charging a data current to the data line for a designated period which is set before a scan pulse is supplied to the electro luminescence cell and after the pre-charge current is supplied; and making the electro luminescence cells emit light by use of the charged current and the data current synchronized with the scan pulse to be supplied to the electro luminescence cell.

In the driving method, the designated period before the scan pulse is supplied to the electro luminescence cells and after the pre-charge current is supplied is obtained from a light emitting period of the electro luminescence cell.

In the driving method, the designated period before the scan pulse is supplied to the electro luminescence cells and after the pre-charge current is supplied is obtained by maintaining the light emitting period of the electro luminescence cells and by lengthening a period from a starting point of the scan pulse to a starting point of the next scan pulse.

In the driving method, an early increase and decrease rate and a latter increase and decrease rate of a current charged in the data line for the designated period before the scan pulse is supplied to the electro luminescence cells and after the pre-charge current is supplied are different from each other.

In the driving method, an early increase and decrease rate of a current charged in the data line for the designated period before the scan pulse is supplied to the electro luminescence cells and after the pre-charge current is supplied is higher than the latter increase and decrease rate.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 6 to 10B, embodiments of the present invention will be explained as follows.

Figure 1:
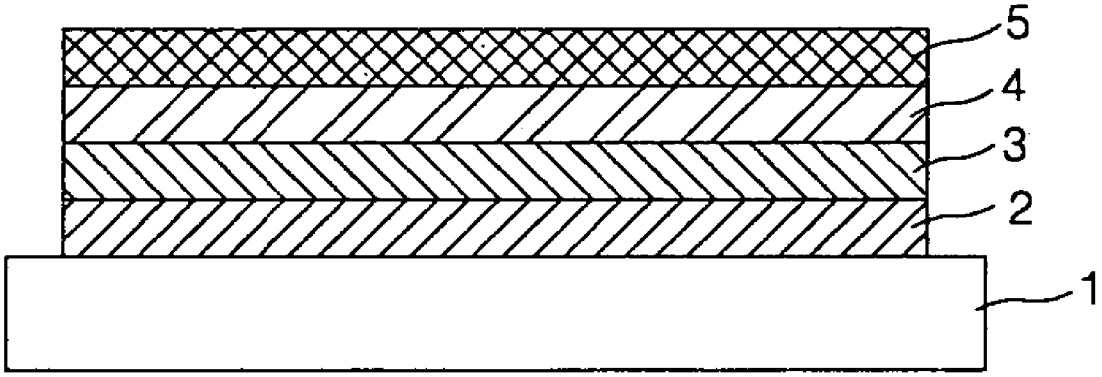
FIG. 1 RELATED ART
FIG. 1 is a cross sectional view briefly representing a unit device of an organic electro luminescence display device of the related art.
Figure 2:
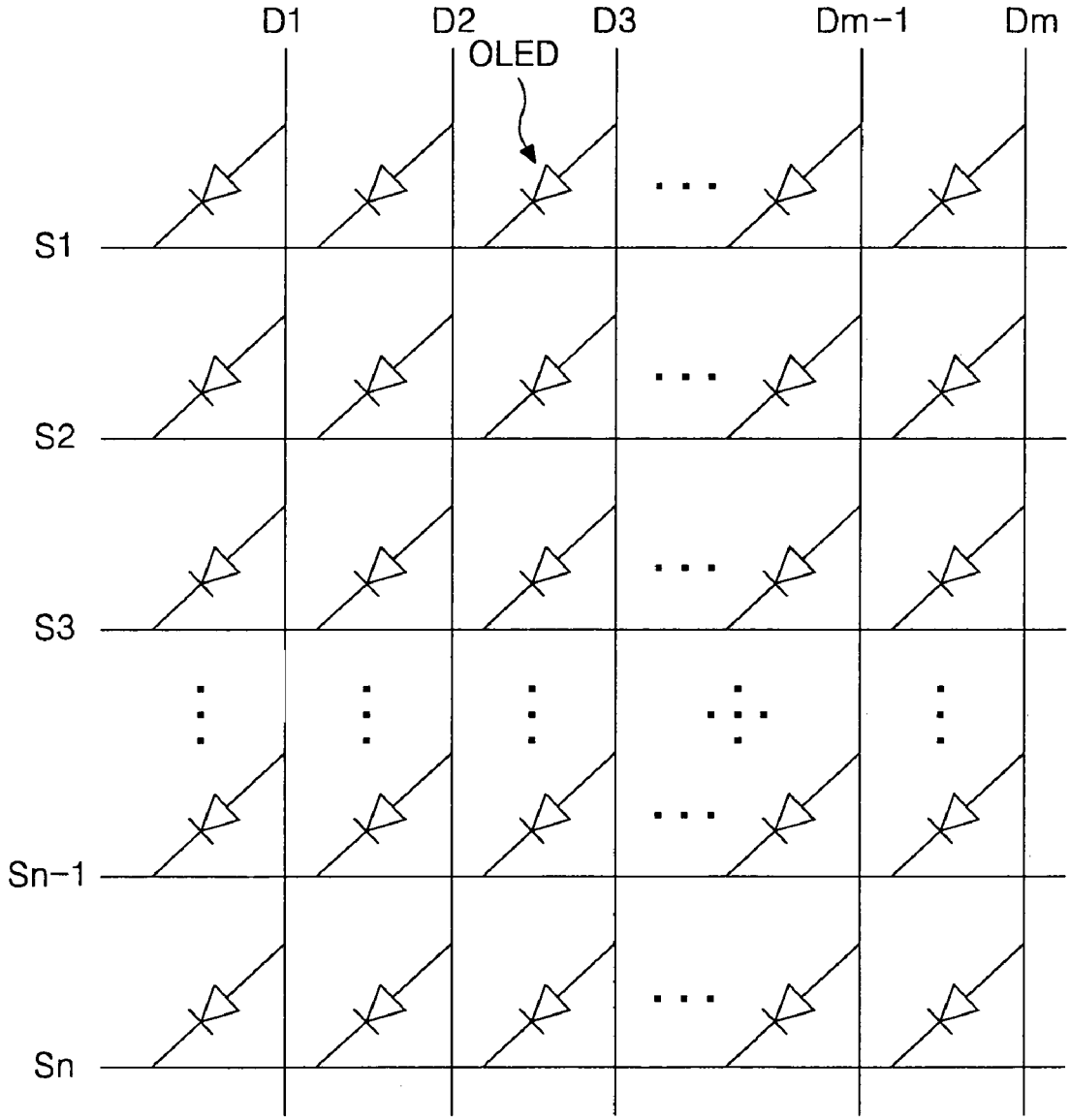
FIG. 2 RELATED ART
FIG. 2 is a diagram equivalently representing an array of a passive type organic electro luminescence display device.
Figure 3:
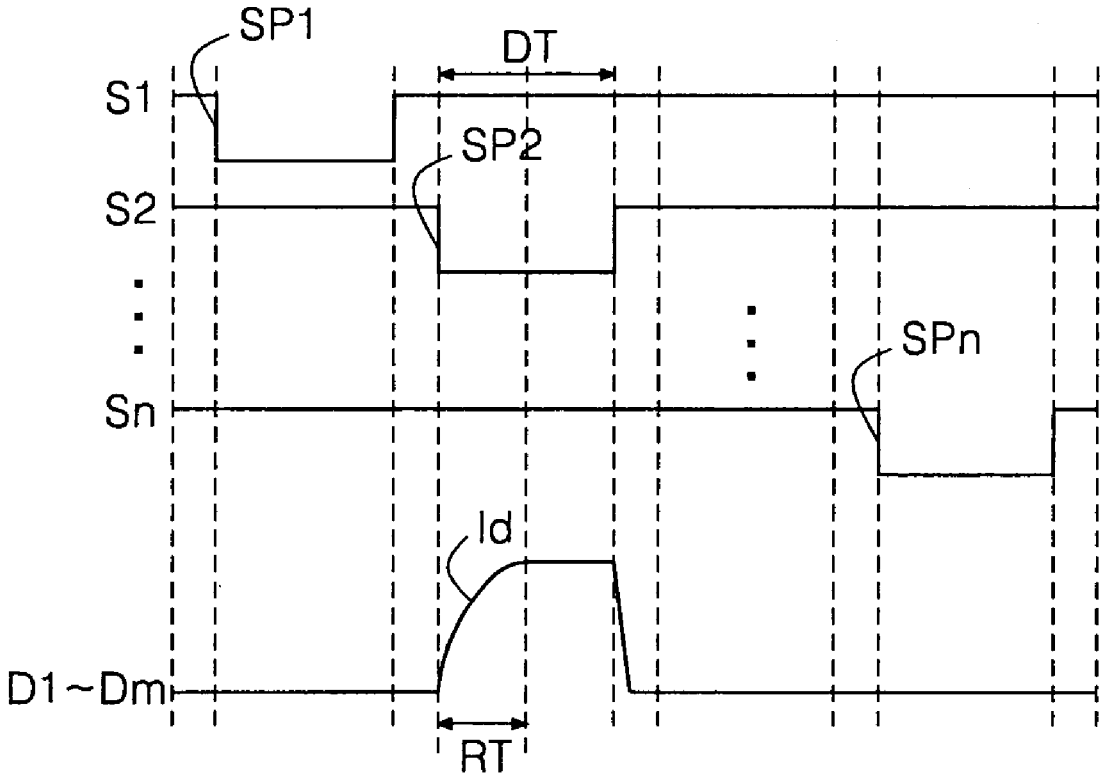
FIG. 3 RELATED ART
FIG. 3 is a waveform diagram representing a delay of a response time generated in a driving method of the organic electro luminescence display device of the related art.
Figure 4:
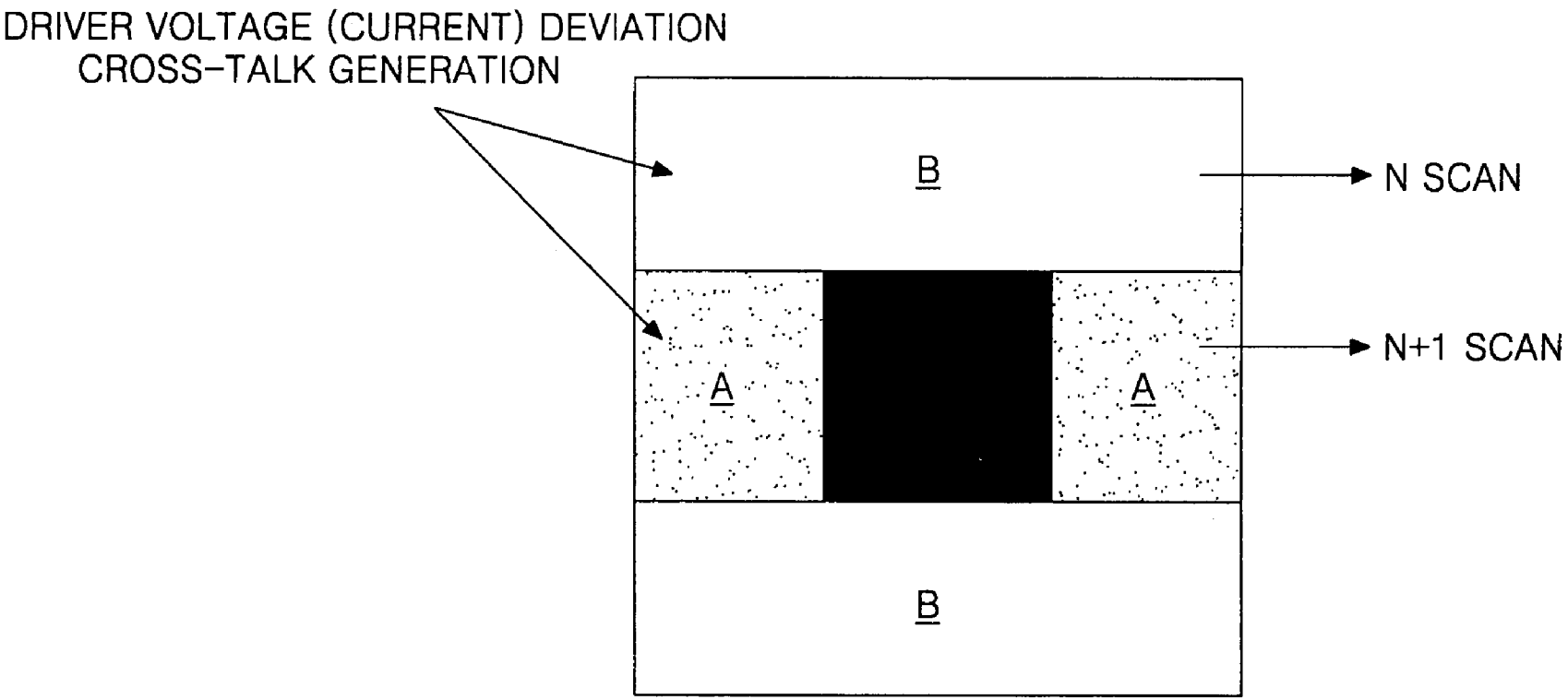
FIG. 4 RELATED ART
FIG. 4 is a diagram representing a cross talk generation within the same picture area in accordance with the drive voltage (current) deviation of the related art.
Figure 5:
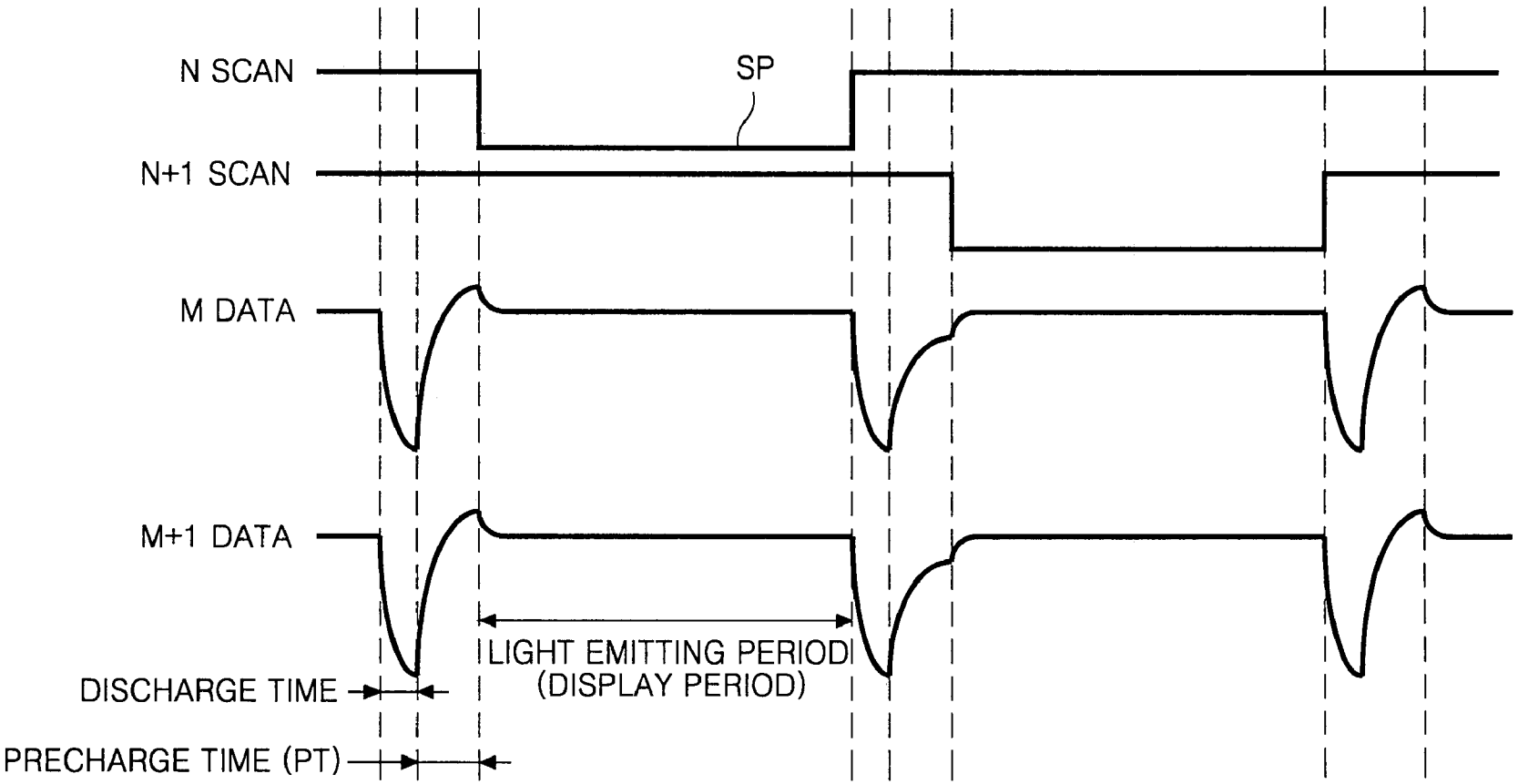
FIG. 5 RELATED ART
FIG. 5 is a waveform diagram representing that there is generated a deviation between data currents charged within a picture area which expresses the same gray level.
Figure 6:
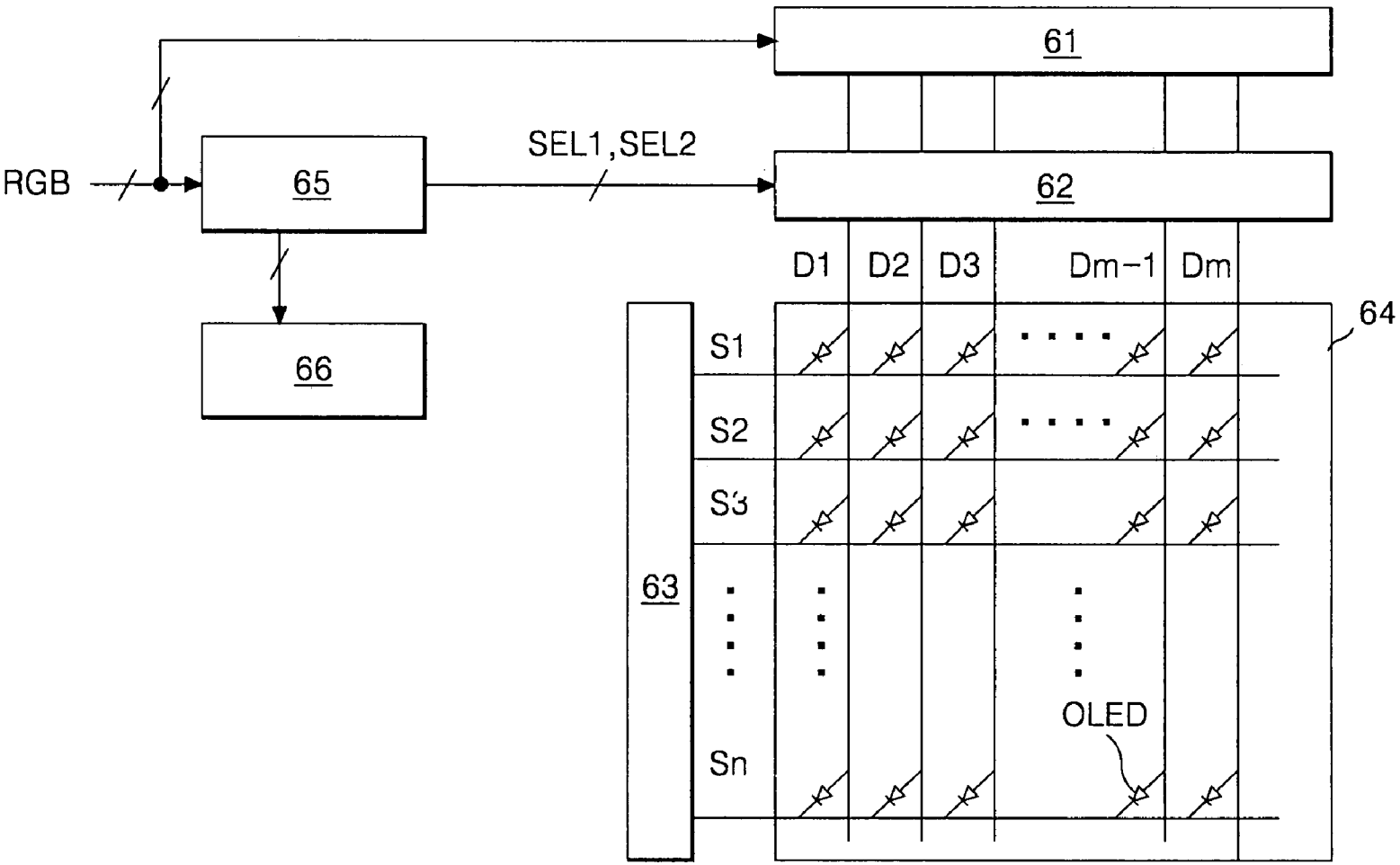
FIG. 6 is a block diagram representing an organic electro luminescence display device according to an embodiment of the present invention.

Referring to FIG. 6, an organic EL display device according to an embodiment of the present invention includes a display panel 64 where m×n number of organic EL cells OLED are arranged in a matrix type; a data driver 61 for generating a data current; a pre-charge driver 62 for generating a pre-charge current; a scan driver 63 for generating a scan pulse synchronized with the data current; and a pre-charge/data controller 65 for controlling the pre-charge driver 62.

In the display panel 64, m number of data lines D1 to Dm cross n number of scan lines S1 to Sn, and the organic EL cells OLED are arranged between the crossing parts thereof.

The data driver 61 includes a shift register circuit for sequentially sampling data, and a current source such as a current mirror circuit or a current sink circuit. The data driver 61 samples digital video data, and supplies the data current corresponding to the gray level value of the digital video data RGB to the data lines D1 to Dm through the pre-charge driver 62.

The scan driver 63 includes a shift register circuit for sequentially shifting scan pulses, and sequentially supplies the scan pulses synchronized with the data currents to the scan lines S1 to Sn.

The pre-charge driver 62 supplies the pre-charge current to the data lines D1 to Dm prior to the data current under control of the pre-charge/data controller 65.

The pre-charge/data controller 65 judges the gray level value of the digital video data RGB, and reads pre-charge current data corresponding to the gray level value from a lookup table 66. And, the pre-charge/data controller 65 receives a clock signal and a vertical/horizontal synchronization signal (not shown) to selectively generate control signals SEL1, SEL2 corresponding to the pre-charge current data, and controls the pre-charge driver 62 by use of the control signals SEL1, SEL2. Herein, the first control signal SEL1 is a control signal generated for a pre-charge period prior to a scan period (or light emitting period) and a delay period to select the amount of the pre-charge current for supplying the pre-charge current to the data lines D1 to Dm for the pre-charge period. The second control signal SEL2 is a control signal for supplying the data current to the data lines D1 to Dm as well as intercepting the supply of the pre-charge current after the pre-charge period.

The lookup table 66 has the pre-charge current data registered, wherein the pre-charge current data correspond to each gray level of the digital video data RGB.

Figure 7:
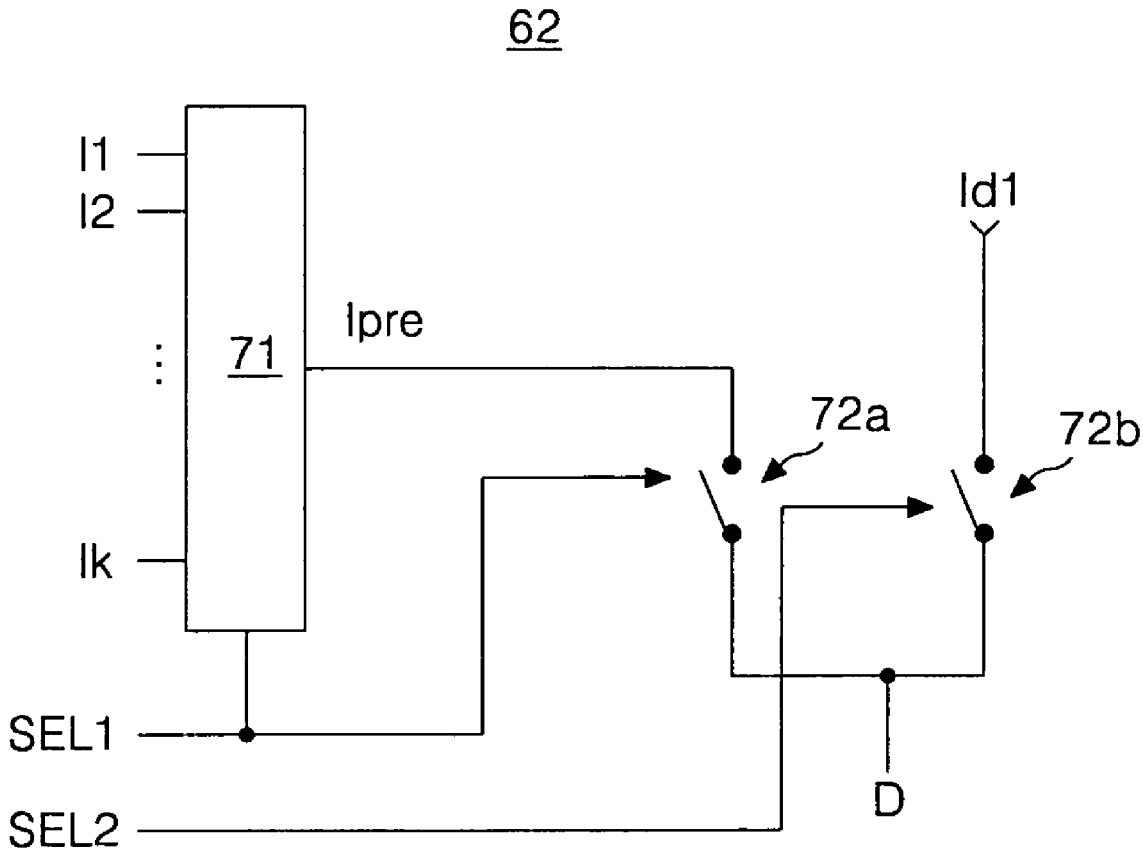
FIG. 7 is a circuit diagram representing a pre-charge driver shown in FIG. 6 in detail.

FIG. 7 represents a pre-charge driver 62 in detail.

The pre-charge driver 62 shown in FIG. 7 includes a selector 71 for selecting the current amount of a pre-charge current Ipre; a first switch device 72A for supplying the pre-charge current Ipre to the data line D; and a second switch device 72B for supplying a data current Id1 to the data line D. The second switch device 72B might be included in the data driver 61.

The current selector 71 selects the pre-charge current Ipre in any one of k (but, 'k' is a positive integer of 2 or more) number of current sources I1, I2, . . . , Ik, of which the current amount is different from each other, to supply to the first switch device 72A in response to a first selection signal SEL1 from the pre-charge/data controller 65.

The first switch device 72A supplies the pre-charge current Ipre selected by the current selector 71 to the data line for the pre-charge period prior to the light emitting period and the delay period in response to the first selection signal SEL1 from the pre-charge/data controller 65.

The second switch device 72B supplies the data current Id1 from the data driver 61 to the data line D1 for the delay period and the light emitting period in response to the second selection signal SEL2 from the pre-charge/data controller 65.

Figure 8:
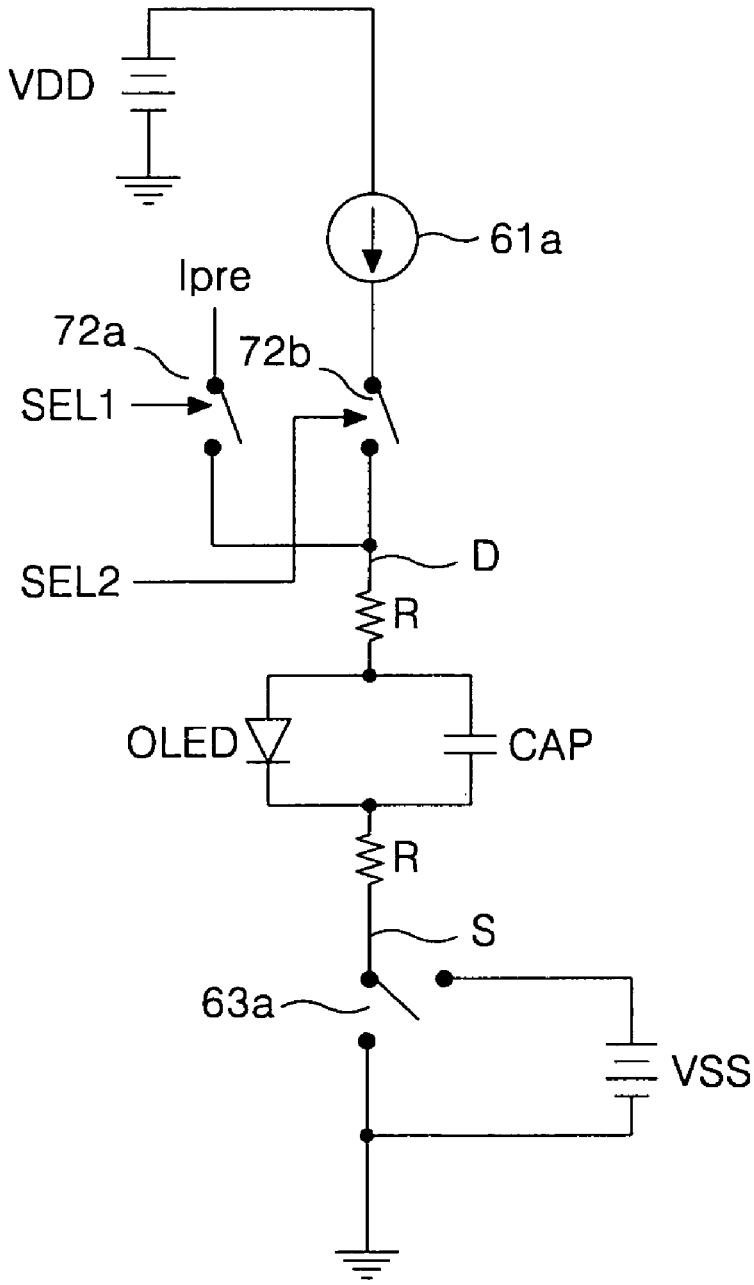
FIG. 8 is a circuit diagram equivalently representing a display panel and drive circuits thereof shown in FIG. 6.

FIG. 8 is a circuit diagram equivalently representing the data line D and the organic EL cell OLED of the display panel and the drive circuit shown in FIG. 7.

In FIG. 8, the reference numeral 'R' is a parasitic resistance between the organic EL devices OLED in the data line, and 'CAP' is a parasitic capacitance of the organic EL cell OLED. And, '61A' is a static current source included in the data driver 61 and generates the data current. '63A' is a switch device included in the scan driver 63, and applies a ground voltage GND to a cathode of the organic EL cell OLED for the light emitting period (or display period) and supplies a positive scan bias voltage to the cathode of the organic EL cell OLED for a non-display period inclusive of the pre-charge period and the delay period except the light emitting period. 'VDD' is a high potential drive voltage applied to the static current source 61A, and 'VSS' is a scan bias voltage applied to the cathode of the organic EL cell OLED for the non-display period, i.e., for the non-scan period.

Figure 9:
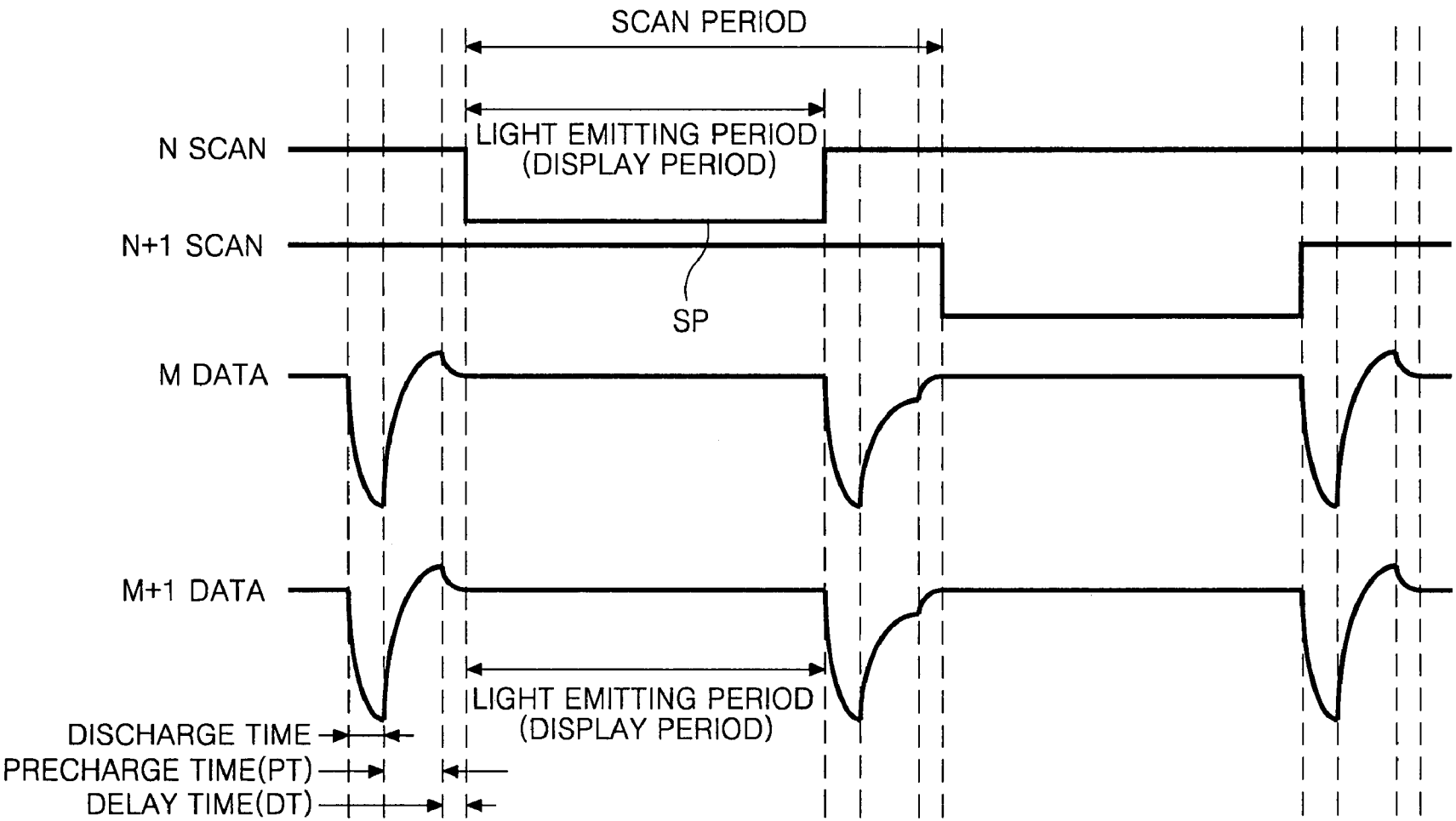
FIG. 9 is a waveform diagram representing a pre-charge driving-method according to the embodiment of the present invention.

In the organic EL display device according to the present invention having such a structure, as shown in FIG. 9, there is provided a delay period DT which is a period before a scan pulse SP from the scan driver 63 is supplied to the organic EL cell OLED after the pre-charge current is supplied from the pre-charge driver 62. In the delay period DT, the scan pulse SP is not applied to the organic EL cell OLED, but the data current is made to be able to be charged in the data line D, thereby enabling to prevent the brightness difference between areas which express the same gray level. As a result, it is possible to prevent a horizontal cross talk.

This will be more specifically explained as follows, in reference to a drive waveform shown in FIG. 9.

Firstly, in a pre-charge period PT, the amount of the current charged in the data line corresponding to the $(N+1)^{th}$ scan line in contradiction to the same pre-charge period PT is relatively lower than the amount of the current charged in the data line corresponding to the $N^{th}$ scan line in accordance with the difference of the loading quantity between the $(N+1)^{th}$ scan line and the $N^{th}$ scan line.

In the delay period DT, the data current is supplied to the data line, but no scan pulse SP is supplied to the scan line. Accordingly, the organic EL cell OLED does not emit light, and the data current can only be charged in the data line. As a result, during the delay period Dt, the amount of the current charged in the data-lines corresponding to the $(N+1)^{th}$ scan line of which the loading quantity is relatively low is increased, and the amount of the current charged in the data lines corresponding to the $N^{th}$ scan line of which the loading quantity is relatively high is reduced. Accordingly, if the delay period DT lapses, the deviation between the data current corresponding to the $(N+1)^{th}$ scan line and the data current corresponding to the $N^{th}$ scan line is relaxed, thus no brightness difference is generated between the $N^{th}$ scan line and the $(N+1)^{th}$ scan line.

In this way, the present invention has the pre-charge period PT and the delay period DT before the scan pulse SP is supplied, thereby enabling to compensate the brightness difference in accordance with the difference of the loading quantity in the horizontal line. As a result, in case of realizing the same picture, a problem such as cross talk, etc does not appear, thereby making it possible to improve the display quality.

Hereinafter, a method of providing the delay period DT in the present invention will be explained as follows in reference to FIGS. 10A and 10B.

Figure 10A:
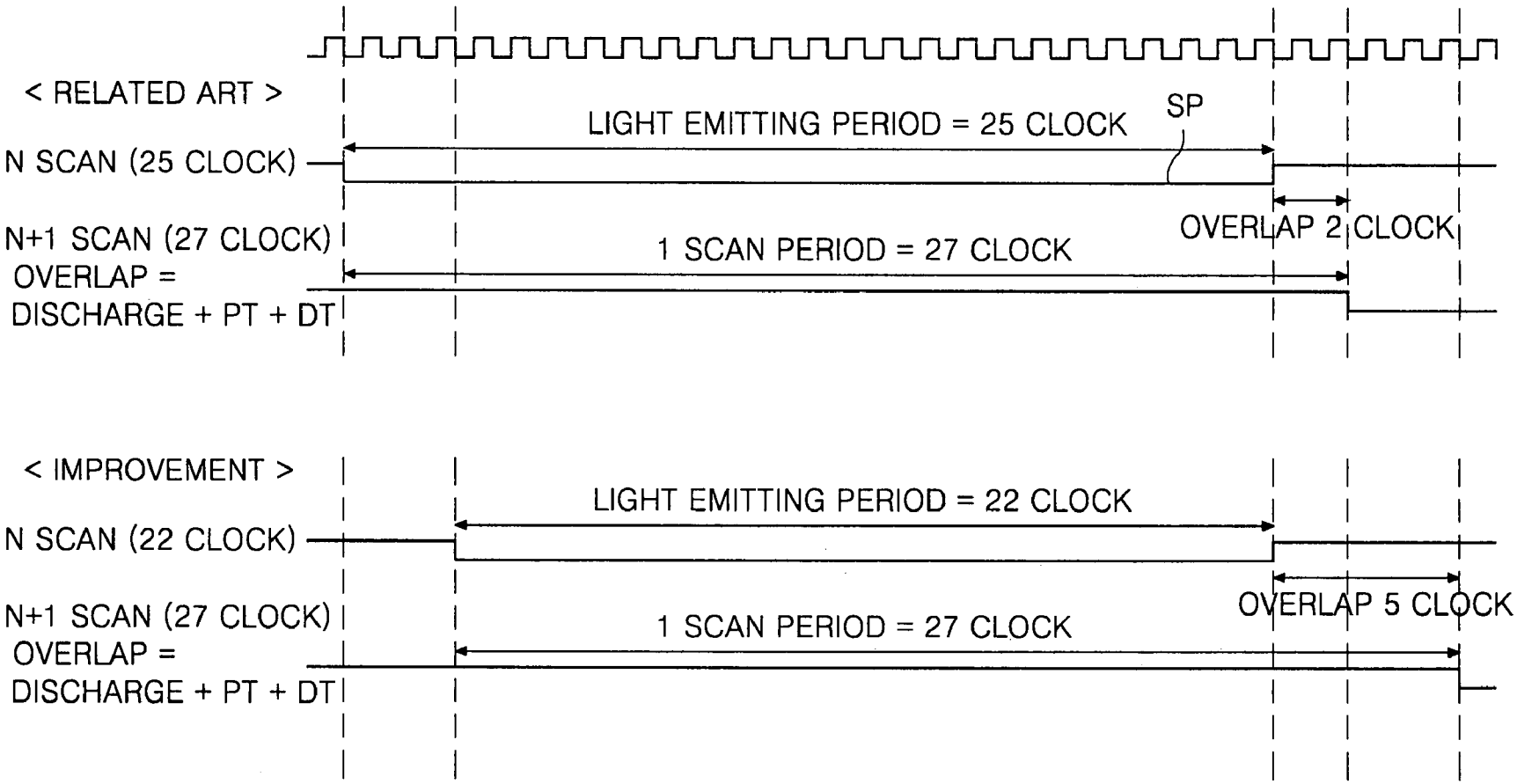
FIGS. 10A and 10B are diagrams explaining a method for providing a delay period in FIG. 9.

Firstly, a first method of providing the delay period DT of the present invention is illustrated in FIG. 10A. When comparing the improved driving method shown in FIG. 10A with the driving method of the related art, in the improved waveform, an applying time of the scan pulse SP is reduced more than the related art and the applying time the reduced scan pulse SP is used as the delay period DT.

That is to say, times (hereinafter, referred to as 'scan period') from a starting point of the $N^{th}$ scan pulse SP to a starting point of the $(N+1)^{th}$ scan pulse SP are maintained identically, and a time (hereinafter, referred to as 'light emitting period' or 'display period') when the scan pulse SP is in fact applied is set to be shorter than the related art, thereby providing the delay period DT.

This can be set by controlling the number of main clock signals in the system. For example, a counter counting one scan period is made to be 27 clocks to maintain the same number as the related art, and at the same time, a counter in the light emitting period is reduced to 22 clocks less than 25 clocks. At this moment, as much as the reduced number of clocks are spared for setting the delay period DT, thereby making it possible to provide the delay period DT. That is to say, in the improved method as shown in FIG. 10A, an overlap period between the light emitting period and the next light emitting period is set as the delay period DT, thus it can be known that the whole overlap period is lengthened more than the related art. Herein, the light emitting period is shortened as much as the number of the increased clocks for the delay period DT, thus there is no change in the frame frequency.

Figure 10B:
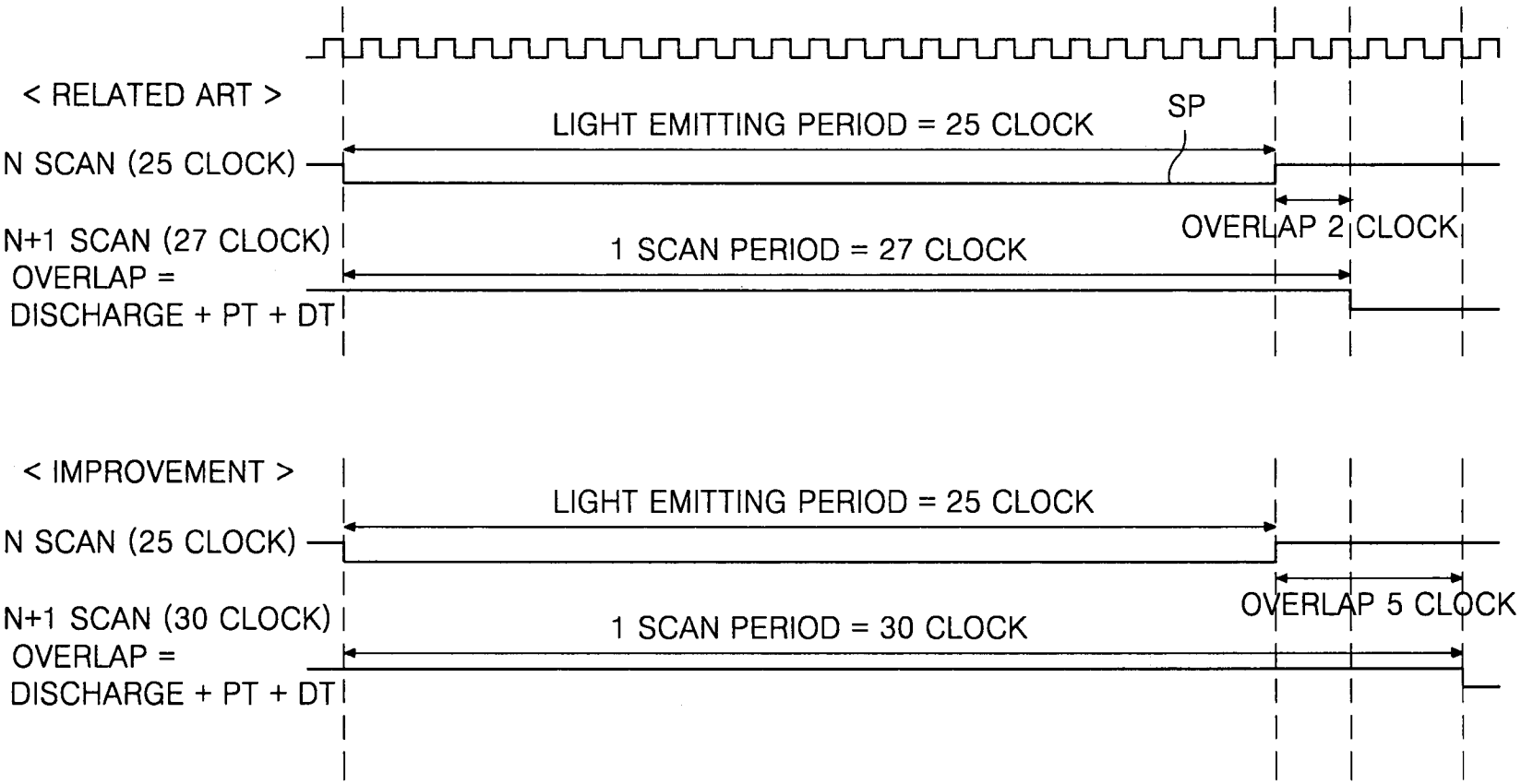

In a second method for providing the delay period DT, in reference to FIG. 10B, the light emitting period is maintained but the scan period is lengthened, thereby providing the delay period DT.

For example, the $N^{th}$ and $(N+1)^{th}$ light emitting periods (25 clocks) are maintained and the scan period from the starting point of the $N^{th}$ scan pulse SP to the starting point of the $(N+1)^{th}$ scan pulse SP is increased from 27 clocks of the related art to 30 clocks, thereby enabling to provide the delay period DT. That is to say, the delay period DT is also included in FIG. 10B like FIG. 10A, thus it can be known that the whole overlap period is lengthened more than the related art.

On the other hand, the method for setting the delay period DT in the present invention is not limited to FIGS. 10A and 10B, and any known method can be used.

In conjunction with FIGS. 6 to 9, the driving method of the organic EL display device according to the embodiment of the present invention will be explained.

The first switch device 72A of the pre-charge driver 62 is turned on during the pre-charge period PT prior to the light emitting period and the delay period DT to supply the pre-charge current Ipre selected in accordance with the gray level of the digital video data RGB by the pre-charge/data controller 65 to the data lines D1 to Dm. Then, the pre-charge current Ipre is charged in the data lines D1 to Dm for the pre-charge period PT.

Subsequently to the pre-charge period PT, the first switch device 72A is turned off and the second switch device 72B is turned off, thus the supply of the pre-charge current is stopped and the delay period DT when the data current is supplied is continued. In such a delay period DT, the scan pulse SP is not applied to the organic EL cell OLED and the data current is charged in the data line D. As a result, if the delay period DT lapses, the drive voltage difference between the areas which express the same gray level is relaxed, thus no brightness difference appears between the areas.

Subsequently to the pre-charge period PT and the delay period DT, in the light emitting period, the second switch device 72B is maintained to be turned on and the switch device 63A of the scan driver 63 sequentially supplies the scan pulse of the ground voltage GND to the scan lines S1 to Sm. During the light emitting period, the organic EL cells OLED emit light as the data current Id1 flows from the anode to the cathode by the positive bias.

On the other hand, the organic EL display device and the driving method thereof according to the embodiment of the present invention is explained as the passive type, but it can be applied to any known active type organic EL display device.

As described above, the organic EL display device and the driving method thereof according to the present invention sets the delay period between the pre-charge period and the light emitting period and supplies the data current to the data lines during the delay period. Accordingly, the brightness difference caused by the difference of the data loading quantity is relaxed for the delay period, thereby enabling to prevent the cross talk. As a result, it is possible to improve the display quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic electro luminescence display device, comprising:

a display panel where a plurality of data lines cross a plurality of scan lines and electro luminescence cells are arranged in the crossing parts thereof;

a pre-charge driver for supplying a pre-charge current to the data line in accordance with gray levels of data; and a data driver for charging a data current to the data line for a designated period which is set before a scan pulse is supplied to the electro luminescence cell and after the pre-charge current is supplied, wherein the designated period before the scan pulse is supplied to the electro luminescence cells and after the pre-charge current is supplied is obtained by maintaining the light emitting period of the electro luminescence cells and by lengthening a period from a starting point of the scan pulse to a starting point of the next scan pulse.

2. The organic electro luminescence display device according to claim 1, wherein the data driver supplies the data current for electro luminescence to the electro luminescence cell at the same time as a scan pulse is supplied to the electro luminescence cell.

3. The organic electro luminescence display device according to claim 2, further comprising:

a scan driver for supplying the scan pulse synchronized with the data current supplied to the electro luminescence cell to the scan lines.

4. The organic electro luminescence display device according to claim 1, further comprising:

a lookup table having pre-charge current data registered, wherein the pre-charge current data indicates the current amount of the pre-charge current corresponding to a gray level of the data; and a controller for controlling the pre-charge driver in accordance with the supply of the data current and the pre-charge current.

5. The organic electro luminescence display device according to claim 1, wherein the pre-charge driver includes:

a plurality of current sources of which the current values are different from each other;

a selector for selecting any one of the current sources as the pre-charge current; and first and second switch devices for selectively supplying the pre-charge current and the data current to the data line.

6. The organic electro luminescence display device according to claim 1, wherein an early increase and decrease rate and a latter increase and decrease rate of a current charged in the data line for the designated period before the scan pulse is supplied to the electro luminescence cells and after the pre-charge current is supplied are different from each other.

7. The organic electro luminescence display device according to claim 1, wherein an early increase and decrease rate of a current charged in the data line for the designated period before the scan pulse is supplied to the electro luminescence cells and after the pre-charge current is supplied is higher than the a latter increase and decrease rate.

8. A driving method of an organic electro luminescence display device where a plurality of data lines cross a plurality of scan lines and electro luminescence cells are arranged in the crossing parts thereof, comprising:

supplying a pre-charge current to the data line in accordance with gray levels of data;

charging a data current to the data line for a designated period which is set before a scan pulse is supplied to the electro luminescence cell and after the pre-charge current is supplied; and making the electro luminescence cells emit light by use of the charged current and the data current synchronized with the scan pulse to be supplied to the electro luminescence cell, wherein the designated period before the scan pulse is supplied to the electro luminescence cells and after the pre-charge current is supplied is obtained by maintaining the light emitting period of the electro luminescence cells and by lengthening a period from a starting point of the scan pulse to a starting point of the next scan pulse.

9. The driving method according to claim 8, wherein an early increase and decrease rate and a latter increase and decrease rate of a current charged in the data line for the designated period before the scan pulse is supplied to the electro luminescence cells and after the pre-charge current is supplied are different from each other.

10. The driving method according to claim 8, wherein an early increase and decrease rate of a current charged in the data line for the designated period before the scan pulse is supplied to the electro luminescence cells and after the pre-charge current is supplied is higher than a latter increase and decrease rate.

* * * * *